US008789926B2

(12) United States Patent
Endo et al.

(10) Patent No.: US 8,789,926 B2
(45) Date of Patent: Jul. 29, 2014

(54) DRIVING CIRCUIT, LIQUID DISCHARGE SUBSTRATE, AND INKJET PRINTHEAD

(75) Inventors: Wataru Endo, Saitama (JP); Masanobu Oomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/493,185

(22) Filed: Jun. 11, 2012

(65) Prior Publication Data

US 2013/0010033 A1 Jan. 10, 2013

(30) Foreign Application Priority Data

Jul. 7, 2011 (JP) ..... 2011-151193

(51) Int. Cl.
*B41J 2/05* (2006.01)

(52) U.S. Cl.
USPC ..... 347/57

(58) Field of Classification Search
None
See application file for complete search history.

(56) References Cited

U.S. PATENT DOCUMENTS

| | | | | | |
|---|---|---|---|---|---|
| 5,359,239 | A | * | 10/1994 | Sato | 326/27 |
| 5,821,588 | A | * | 10/1998 | Ohmae | 257/366 |
| 6,474,788 | B1 | | 11/2002 | Saito et al. | |
| 2006/0226499 | A1 | | 10/2006 | Shimizu | |

FOREIGN PATENT DOCUMENTS

| | | | | | |
|---|---|---|---|---|---|
| CN | 1254647 | A | | 5/2000 | |
| EP | 1233452 | A2 | | 8/2002 | |
| JP | 11-138775 | | * | 5/1999 | B41J 2/01 |
| JP | 11-138775 | A | | 5/1999 | |
| JP | 2003-69414 | A | | 3/2003 | |

OTHER PUBLICATIONS

Office Action in Chinese Patent Application No. 201210226799.7, dated Mar. 4, 2014.

* cited by examiner

*Primary Examiner* — Geoffrey Mruk
(74) *Attorney, Agent, or Firm* — Fitzpatrick, Cella, Harper & Scinto

(57) ABSTRACT

A driving circuit which includes a plurality of MOS transistors electrically connected in parallel between a first node and a second node, and drives a load electrically connected between the first node and a third node by the plurality of MOS transistors, wherein the plurality of MOS transistors include at least two MOS transistors having channel lengths different from each other and thus having threshold voltages different from each other.

5 Claims, 5 Drawing Sheets

DRIVING CIRCUIT, LIQUID DISCHARGE SUBSTRATE, AND INKJET PRINTHEAD

BACKGROUND OF THE INVENTION

1. Field of the Invention

The present invention relates to a driving circuit, liquid discharge substrate, and inkjet printhead.

2. Description of the Related Art

Japanese Patent Laid-Open No. 11-138775 discloses a ringing suppression circuit in which a plurality of switching elements are connected in parallel and a timing control circuit controls the switching timings of the respective switching elements to differ from each other. Japanese Patent Laid-Open No. 2003-069414 discloses an output circuit in which the thresholds of a plurality of transistors are set to different values by setting the substrate impurity concentrations or substrate potentials of the transistors to different values.

However, these related arts have the following problems. The former technique needs to arrange a new timing circuit to set the driving timings of a plurality of switching elements to differ from each other. This increases the circuit area. The latter technique changes the substrate impurity concentration or substrate potential between a plurality of transistors. For this purpose, a step needs to be added to the manufacturing process, raising the manufacturing cost.

SUMMARY OF THE INVENTION

The present invention provides a driving circuit which has a small circuit area and simple manufacturing process, and can suppress ringing.

The first aspect of the present invention provides a driving circuit which includes a plurality of MOS transistors electrically connected in parallel between a first node and a second node, and drives a load electrically connected between the first node and a third node by the plurality of MOS transistors, wherein the plurality of MOS transistors include at least two MOS transistors having channel lengths different from each other and thus having threshold voltages different from each other.

The second aspect of the present invention provides a liquid discharge substrate including a channel for a liquid, a heating element which heats the liquid in the channel and the above described driving circuit which drives the heating element as a load.

The third aspect of the present invention provides an inkjet printhead including a channel communicating with an orifice for ink, a heating element which heats the ink in the channel and the above described driving circuit which drives the heating element as a load.

Further features of the present invention will become apparent from the following description of exemplary embodiments (with reference to the attached drawings).

DESCRIPTION OF THE EMBODIMENTS

Figure 1:
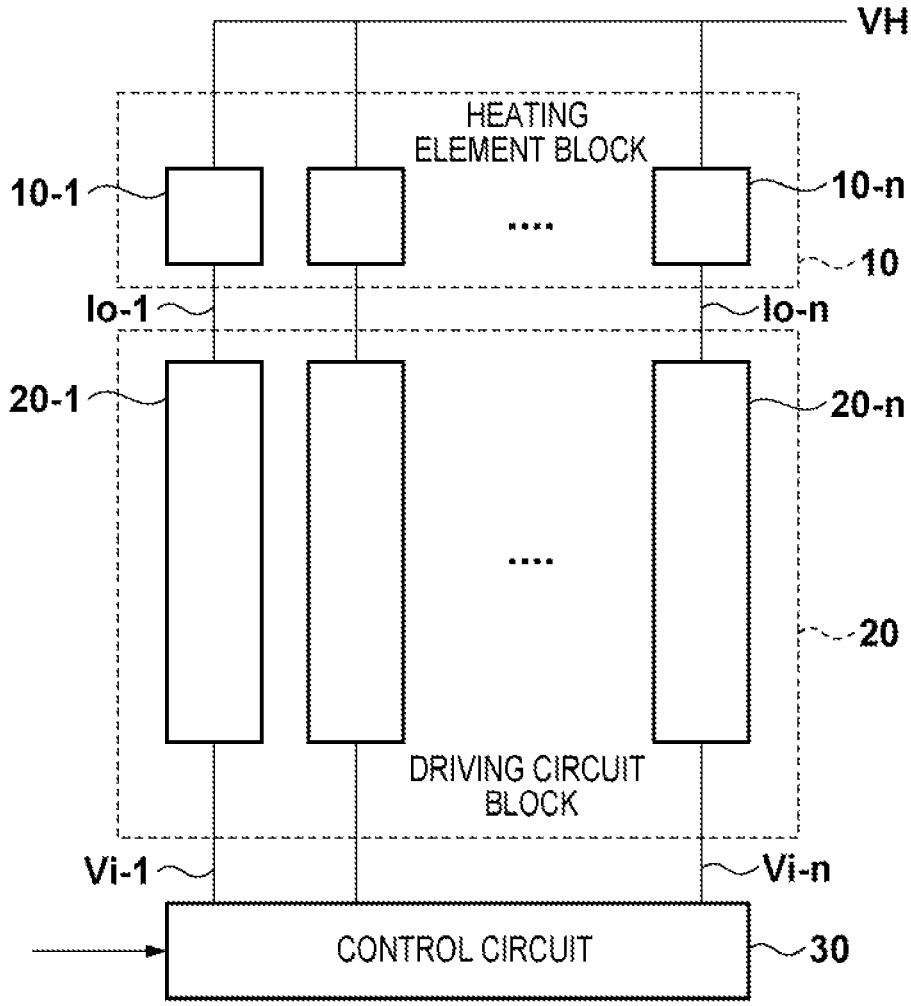
FIG. 1 is a circuit diagram of an inkjet printhead according to an embodiment of the present invention.

A preferred embodiment of the present invention will now be described with reference to the accompanying drawings. FIG. 1 is a circuit diagram exemplifying an inkjet printhead according to the embodiment of the present invention. The inkjet printhead includes a heating element block 10, a driving circuit block 20, and a control circuit 30 which controls the driving circuit block 20. The heating element block 10 includes a plurality of heaters 10-1 to **10-*n*. The driving circuit block 20 includes switching circuits 20-1 to 20-*n* to be described with reference to FIG. 2. The control circuit 30 supplies input data to the switching circuits 20-1 to 20-*n*. The control circuit 30 controls the conduction of the switching circuits 20-1 to 20-*n*. A first power supply VH supplies a current to the heaters 10-1 to 10-*n*, causing the heaters 10-1 to 10-*n* to generate heat. Input signals to the switching circuits are Vi-1 to Vi-n, and output current signals are Io-1** to Io-n.

Figure 2:
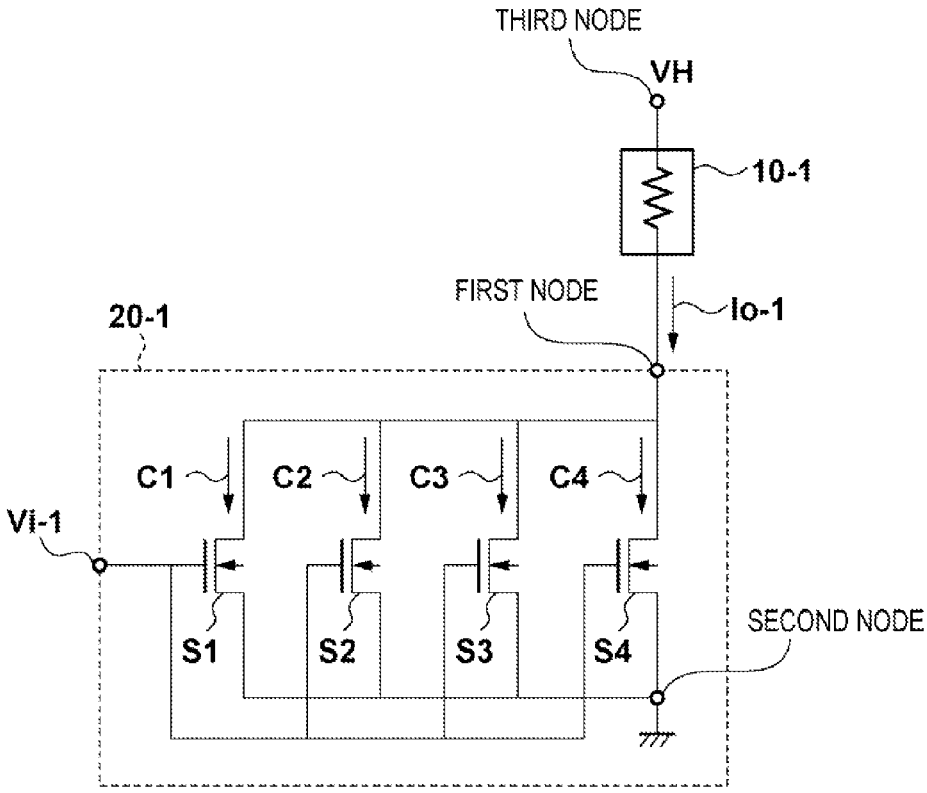
FIG. 2 is a circuit diagram according to the embodiment of the present invention.

FIG. 2 is an equivalent circuit diagram showing the heater 10-1 and switching circuit 20-1 according to the first embodiment of the present invention. The switching circuit 20-1 includes four MOS transistors S1 to S4 serving as switching elements. In this example, the four MOS transistors S1 to S4 have different channel lengths. Because of the short channel effect of the MOS transistor, the threshold voltages of the MOS transistors S1 to S4 are different voltages Vth1 to Vth4. Vth1 to Vth4 have a relation of Vth1<Vth2<Vth3<Vth4.

One end of the output terminals of each of the MOS transistors S1 to S4 is electrically connected to a first node N1. One end of the heater 10-1 serving as a load is electrically connected to the first node N1, and the other end of the heater 10-1 is electrically connected to the first power supply VH via a third node N3. The other end of the output terminals of each of the MOS transistors S1 to S4 is electrically connected to a second node N2. The second node N2 is electrically connected to the second power supply (ground potential in this example). The input gates of the MOS transistors S1 to S4 receive a control signal Vi-1 from the control circuit 30. In this way, the MOS transistors S1 to S4 are electrically connected in parallel. Waveforms $C_1$ to $C_4$ shown in FIG. 3 are the schematic waveforms of current signals respectively flowing through the MOS transistors S1 to S4.

The operation of the switching circuit 20-1 will be explained with reference to FIGS. 2 and 3. First, the control signal Vi-1 is input to the switching circuit. Since the threshold voltages Vth1 to Vth4 of the MOS transistors S1 to S4 differ from each other, currents flowing through the MOS transistors S1 to S4 exhibit the waveforms $C_1$ to $C_4$ schematically shown in FIG. 3. The current C2 rises with a delay $t_1$ from the leading edge of the current C1, and falls at a timing early by $t_1'$ from the trailing edge of the current C1. Similarly, the currents C3 and C4 rise with delays $t_2$ and $t_3$ from the leading edge of the current C1, and fall at timings early by $t_2'$ and $t_3'$. In an ideal state, the output current signal Io(n) of the switching circuit has a stepwise waveform as represented by Io(n) in FIG. 3.

Although the leading and trailing edges of a current flowing through a path extending from the first node to the third node contain almost the same high-frequency components, the amplitude of the high-frequency component of the driving current can be suppressed. As a result, the amplitudes of an overshoot and undershoot can be suppressed, suppressing ringing. Hence, deterioration of the heater 10-1 and MOS transistors S1 to S4, and a malfunction caused by generation of noise can be suppressed.

Figure 3:
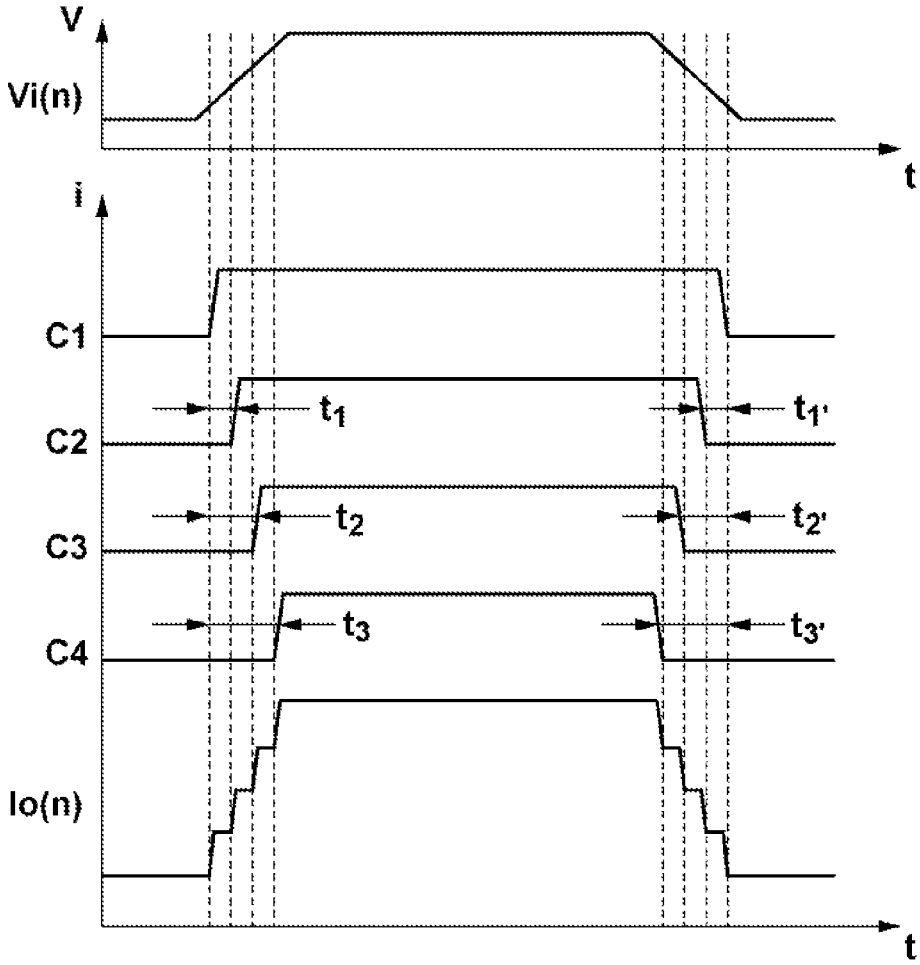
FIG. 3 is a timing chart according to the embodiment of the present invention.

In the first embodiment shown in FIGS. 2 and 3, the number of switching elements in the switching circuit 20(*n*) is four. However, this is merely an example. At least two of a plurality of MOS transistors suffice to have different channel lengths. Even in this case, ringing can be suppressed because timings when currents flow through switches differ from each other owing to the threshold voltage difference. When the power supply voltage of the control circuit 30 is low, a level shift circuit may be interposed between the control circuit 30 and the driving circuit block 20.

Figure 4:
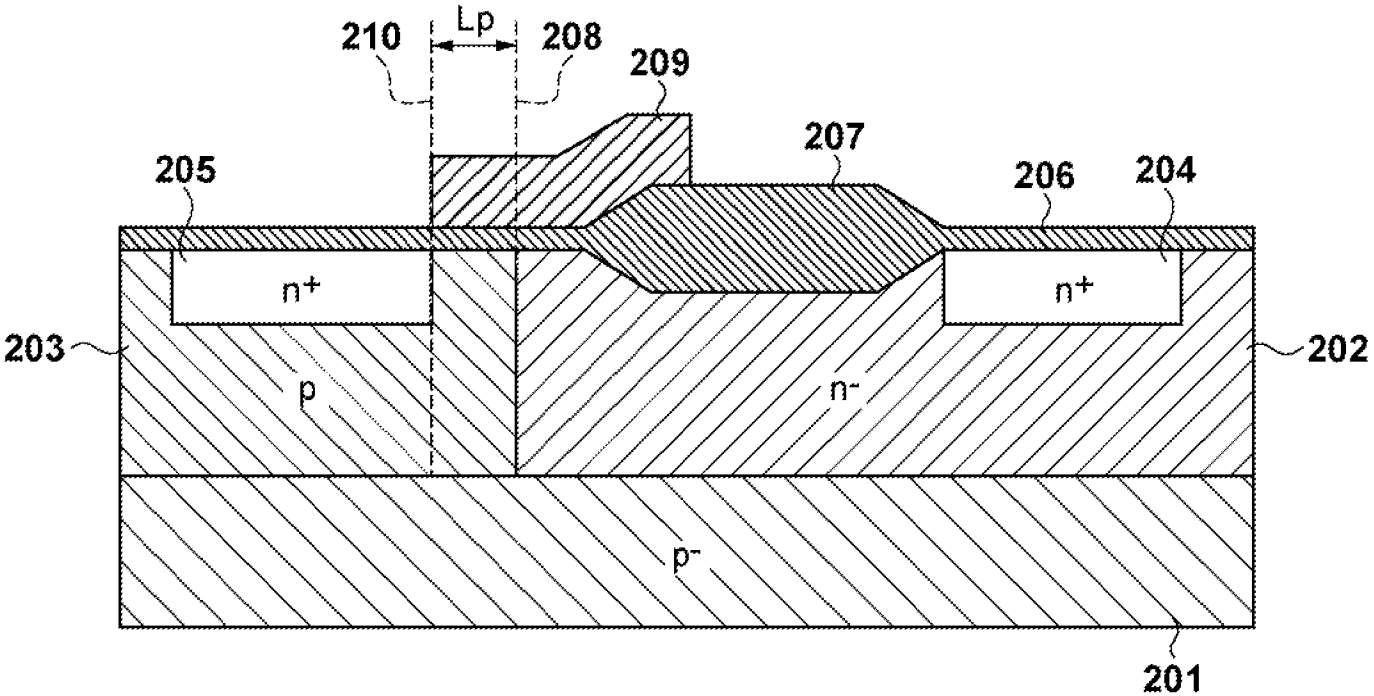
FIG. 4 is a schematic sectional view of a transistor in FIG. 2 according to the embodiment.

FIG. 4 is a schematic sectional view exemplifying the structure of the MOS transistors S1 to S4. In this example, an n-type MOS transistor with a LOCOS offset structure is formed on a p-type silicon semiconductor substrate. However, the structure is arbitrary as long as the transistor can adjust the threshold voltage by the channel length. The LOCOS offset structure is a structure in which an element isolation region is formed between part or all of the gate electrode and part of the drain region to ensure a long distance between the gate electrode and the drain region. This structure is preferable particularly when a high-voltage tolerance is required. The MOS transistor in FIG. 4 is a lateral DMOS (double diffused MOS) transistor. Since the DMOS transistor is also a device excellent in voltage tolerance, simultaneous use of the DMOS transistor and LOCOS offset structure is preferable for higher voltage tolerance. The structure shown in FIG. 4 is merely an example, and the present invention is not limited to this.

In FIG. 4, an $n^-$-type well region 202 and p-type well region 203 are formed on the upper surface of a $p^-$-type semiconductor substrate 201. An $n^+$-type impurity region 204 is formed in part of the surface of the $n^-$-type well region 202. An $n^+$-type impurity region 205 serving as the source is formed in part of the surface of the p-type well region 203. The $n^-$-type well region 202 and $n^+$-type impurity region 204 form the drain region. The p-type well region 203 is a portion where the channel of the MOS transistor is formed, and the channel is formed by a voltage applied to the gate. A gate oxide film 206 is formed on the entire surface of the semiconductor substrate having these thus-formed regions. A LOCOS 207 is formed in part of the gate oxide film 206 in the $n^-$-type well region 202. One end of the LOCOS 207 extends to a position corresponding to the end of the impurity region 204. The other end of the LOCOS 207 extends to a boundary 208 between the $n^-$-type well region 202 and the p-type well region 203. However, the other end of the LOCOS does not reach the position of the boundary 208, and stays at a position in the $n^-$-type well region 202. A gate electrode 209 is formed on the gate oxide film 206 and LOCOS 207 on the upper side of the $n^-$-type well region 202 and p-type well region 203. One end of the gate electrode 209 extends to a position corresponding to the end of the $n^+$-type impurity region 205, and its other end stays on the LOCOS 207. A channel length Lp representing the distance between a boundary 210, which exists between the gate electrode 209 and the $n^+$-type impurity region 205, and the boundary 208 can be defined by a mask when forming the $n^+$-type impurity region 205 in the p-type well region 203 in the manufacturing process. At this time, masks which define different channel lengths can be applied to a plurality of MOS transistors which form a driving circuit. The step of adjusting the channel length Lp does not require an additional process in the manufacturing process, unlike changing the impurity concentration of the substrate. By adjusting the channel length Lp, the threshold voltages of MOS transistors can be made different from each other.

Figure 5:
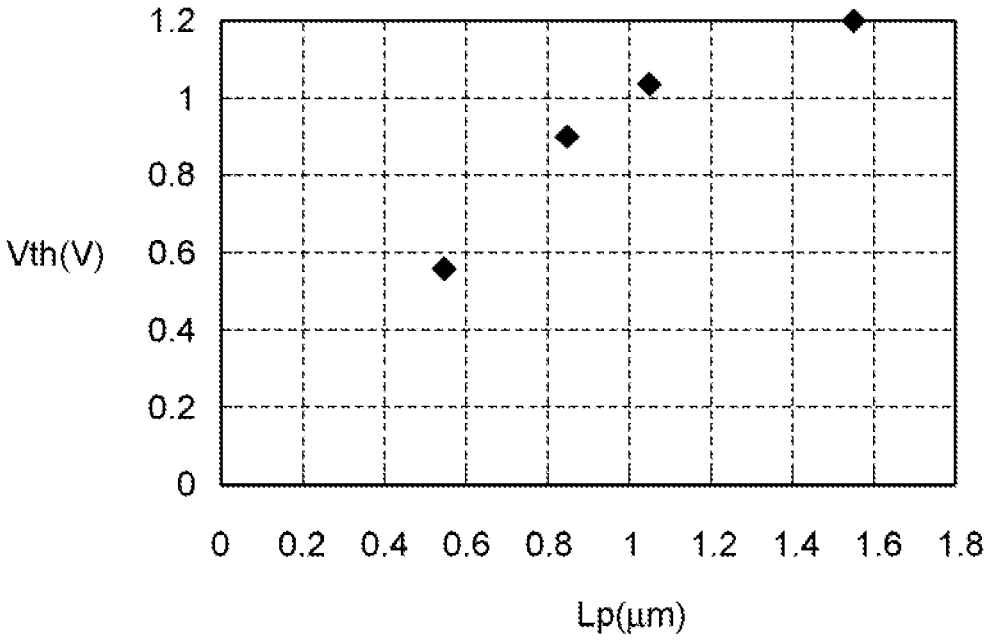
FIG. 5 is a graph of the transistor in FIG. 4 according to the embodiment.

FIG. 5 is a graph exemplifying the characteristic of the short channel effect of the MOS transistor. In this graph, the channel length Lp is plotted along the abscissa axis, and the threshold voltage Vth is plotted along the ordinate axis. As is apparent from FIG. 5, the threshold voltage can be adjusted by finely changing the channel length Lp.

Further, a liquid discharge substrate will be explained. The liquid discharge substrate includes driving circuits according to the present invention, heating elements which are driven by the driving circuits, and liquid channels. The heating element is arranged to heat a liquid in the channel. The liquid in the channel is heated and discharged. The liquid is discharged from an orifice communicating with the channel.

Next, an inkjet printhead will be explained. In the inkjet printhead, a member serving as an ink liquid channel is arranged on an inkjet head substrate including the driving circuits and heating elements according to the present invention. The heating element is arranged to heat the channel. The heating element driven by the driving circuit according to the present invention heats ink in the channel. The ink is then discharged from an ink orifice communicating with the channel, and used to print on printing paper or the like.

As described above, different threshold voltages can be set by adjusting the channel lengths of the MOS transistors S1 to S4. As a result, the switching circuit 20-(*n*) which suppresses generation of ringing can be provided without increasing the circuit area and adding a manufacturing step.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-151193, filed Jul. 7, 2011 which is hereby incorporated by reference herein in its entirety.

What is claimed is:

1. A driving circuit which includes a plurality of MOS transistors electrically connected in parallel between a first node and a second node, and drives a load electrically connected between the first node and a third node by the plurality of MOS transistors, wherein the plurality of MOS transistors include at least two MOS transistors having channel lengths different from each other thereby having threshold voltages different from each other, the at least two MOS transistors include a first MOS transistor and a second MOS transistor having a longer channel length than that of the first MOS transistor, and the second MOS transistor has a larger threshold voltage than that of the first MOS transistor, and wherein each of the plurality of MOS transistors includes:

a first conductivity type well region and a second conductivity type well region formed on a semiconductor substrate, a first conductivity type drain region formed in part of the first conductivity type well region, a first conductivity type source region formed in part of the second conductivity type well region, a LOCOS formed on part of the first conductivity type well region, and a gate electrode formed on the second conductivity type well region via a gate oxide film and on the LOCOS.

2. A liquid discharge substrate comprising:

a channel for a liquid;

a heating element which heats the liquid in the channel; and a driving circuit defined in claim 1, wherein the driving circuit drives the heating element as the load.

3. An inkjet printhead comprising:

a channel for ink communicating with an orifice;

a heating element which heats the ink in the channel; and a driving circuit defined in claim 1, wherein the driving circuit drives the heating element as the load.

4. The circuit according to claim 1, wherein each of the at least two MOS transistors has a channel length less than 1.6 micrometers.

5. The circuit according to claim 1, wherein the distances between the source region and the first conductivity type well region of each of the at least two MOS transistors are different from each other.

* * * * *